US005782613A

United States Patent [19]

Michiyuki et al.

[11] Patent Number: 5,782,613

[45] Date of Patent: Jul. 21, 1998

[54] PISTON TYPE COMPRESSOR WITH STRUCTURE FOR REDUCING CYLINDER BORE DEFORMATION

[75] Inventors: Hiromi Michiyuki, Anjo; Hayato Ikeda, Kariya; Tomoji Tarutani, Kariya; Norikazu Deto, Kariya, all of Japan

[73] Assignee: Kabushiki Kaisha Toyoda Jodoshokki Seisakusho, Aichi-Ken, Japan

[21] Appl. No.: 614,370

[22] Filed: Mar. 12, 1996

[30] Foreign Application Priority Data

Mar. 20, 1995 [JP] Japan ..... 7-060981

[51] Int. Cl.[6] ..... F04B 1/12

[52] U.S. Cl. ..... 417/269; 92/169.2

[58] Field of Search ..... 417/269, 222.2, 417/222.1; 92/169.2, 80

[56] References Cited

U.S. PATENT DOCUMENTS 4,716,720 1/1988 Eickmann ..... 60/39.6

4,746,275 5/1988 Iwamori et al. ..... 417/269

5,556,261 9/1996 Kimura et al. ..... 417/269

*Primary Examiner*—Timothy Thorpe

*Assistant Examiner*—Peter G. Korytnyk

*Attorney, Agent, or Firm*—Woodcock Washburn Kurtz Mackiewicz & Norris LLP

[57] ABSTRACT

A compressor includes a housing body and a drive shaft rotatably supported in the housing body. A swash plate is mounted on the swash shaft. Cylinder bores are defined in the housing body. Pistons are operably coupled to the swash plate and are disposed in the cylinder bores. The swash plate converts a rotation of the swash shaft to a reciprocating movement of the pistons along an inner surface of the cylinder bores. Each piston compresses gas supplied from a suction chamber to the associated cylinder bore and discharges the compressed gas to a discharge chamber. Deformation of the inner surface of each cylinder bore is reduced by utilizing pressure of the gas compressed in the cylinder bore.

22 Claims, 7 Drawing Sheets

PISTON TYPE COMPRESSOR WITH STRUCTURE FOR REDUCING CYLINDER BORE DEFORMATION

BACKGROUND OF THE INVENTION

1. Field of the Invention

This invention generally relates to a reciprocating piston-type compressor, such as those which are commonly used in automotive air conditioning systems. Specifically, the invention provides a solution to the problem of compression-induced deformation of the cylinder bore in such a compressor.

2. Description of the Related Art

Reciprocating piston-type compressors are in use throughout the world, particularly in vehicle air conditioners. FIG. 9 illustrates a conventional compressor of this type. In this compressor, a front housing 55 is secured to a front end face of a front cylinder block 51 through a valve plate 53. A rear housing 56 is secured to a rear end face of a rear cylinder block 52 through a valve plate 54. The cylinder blocks 51 and 52, the valve plates 53 and 54, and the housings 55 and 56 are held together by a plurality of bolts 57. A drive shaft 58 is rotatably supported in center bores formed in both the cylinder blocks 51 and 52. A swash plate 59 is fixed to the drive shaft 58 and is disposed within a crank chamber 60 that is formed between the cylinder blocks 51 and 52. A plurality of aligned pairs of cylinder bores 51*a* and 52*a* are formed in the cylinder blocks 51 and 52 around the drive shaft 58. A double-headed piston 61 is retained in a corresponding pair of cylinder bores 51*a* and 52*a* and is connected to the swash plate 59 through a shoes 62.

As the drive shaft 58 is rotated, the rotation of the swash plate 59 is transmitted to each piston 61 through the shoes 62, and consequently, each piston 61 is reciprocated in a corresponding cylinder bore 51*a* and 52*a*. With the reciprocating motion of the piston 61, suction of refrigerant gas from suction chambers 63 and 64 into the cylinder bores 51*a* and 52*a*, compression of the refrigerant gas in the cylinder bores 51*a* and 52*a*, and discharge of the compressed refrigerant gas to discharge chambers 65 and 66 are carried out.

Suction passages 67 and 68 are formed in the cylinder blocks 51 and 52 around the bolt 57 for communicating suction chambers 63 and 64 with the crank chamber 60.

One problem that exists in compressors of the type that are shown in FIGS. 9–11 is the internal deformation that takes place as a result of the compression that is applied by the assembly bolts that hold the unit together. As shown in FIG. 9, the cylinder blocks 51 and 52, the valve plates 53 and 54, the housings 55 and 56 are clamped together by a plurality of bolts 57. The compression applied by bolts 57 causes the cylinder bores 51*a* and 52*a* to become slightly deformed, as shown by exaggerated scale in the broken line profile that is provided in FIG. 10. The deformation of the cylinder blocks 51 and 52 is greater at the adjoining surfaces thereof, as shown in exaggerated scale by the broken lines in FIG. 11. The amount of radial outward deformation of the cylinder bore 51*a* or 52*a* has been found to be about 8 μm at the maximum, while the radially inward deformation quantity of the cylinder bore 51*a* or 52*a* is about 10 μm at the maximum.

As the cylinder bore deforms, the clearance between the inner peripheral surface of each cylinder bore 51*a* or 52*a* and the outer peripheral surface of the piston 61 increases in places. As a result, refrigerant gas in the cylinder bore 51*a* or 52*a* leaks from the places at which the clearance is large, reducing the efficiency of the compressor. In addition, deformation of the cylinder bore causes portions of the inner peripheral surface of the cylinder bore 51*a* or 52*a* to press against the outer peripheral surface of the piston 61, interfering with the sliding motion of the piston within the bore. This contributes to uneven wear on the piston and the cylinder bore, and, in some cases, might even cause seizure of the piston within the bore.

It is clear that a need exists for an improved compressor assembly that is designed to minimize the undesired effects of internal deformation that takes place as a result of compression-induced deformation of the cylinder bore in such a compressor.

SUMMARY OF THE INVENTION

It is an objective of the invention to provide a reciprocating piston-type compressor which is capable of reducing the deformation of the inner peripheral surface of the cylinder bore at the time of the operation of the compressor.

To achieve the above and other objects of the invention, the compressor according to the present invention includes a housing body and a drive shaft rotatably supported in the housing body. A drive plate is mounted on the drive shaft. Cylinder bores are defined in the housing body. Pistons are operably coupled to the drive plate and are disposed in the cylinder bores. The drive plate converts a rotation of the drive shaft to a reciprocating movement of the pistons along an inner surface of the cylinder bores. Each piston compresses gas supplied from a suction chamber to the associated cylinder bore and discharges the compressed gas to a discharge chamber. A deformation of the inner surface of each cylinder bore is reduced by utilizing pressure of the gas compressed in the cylinder bore.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a swash plate-type compressor of the double-headed piston type embodying the present invention will be described below with reference to FIGS. 1 to 4.

Figure 1:
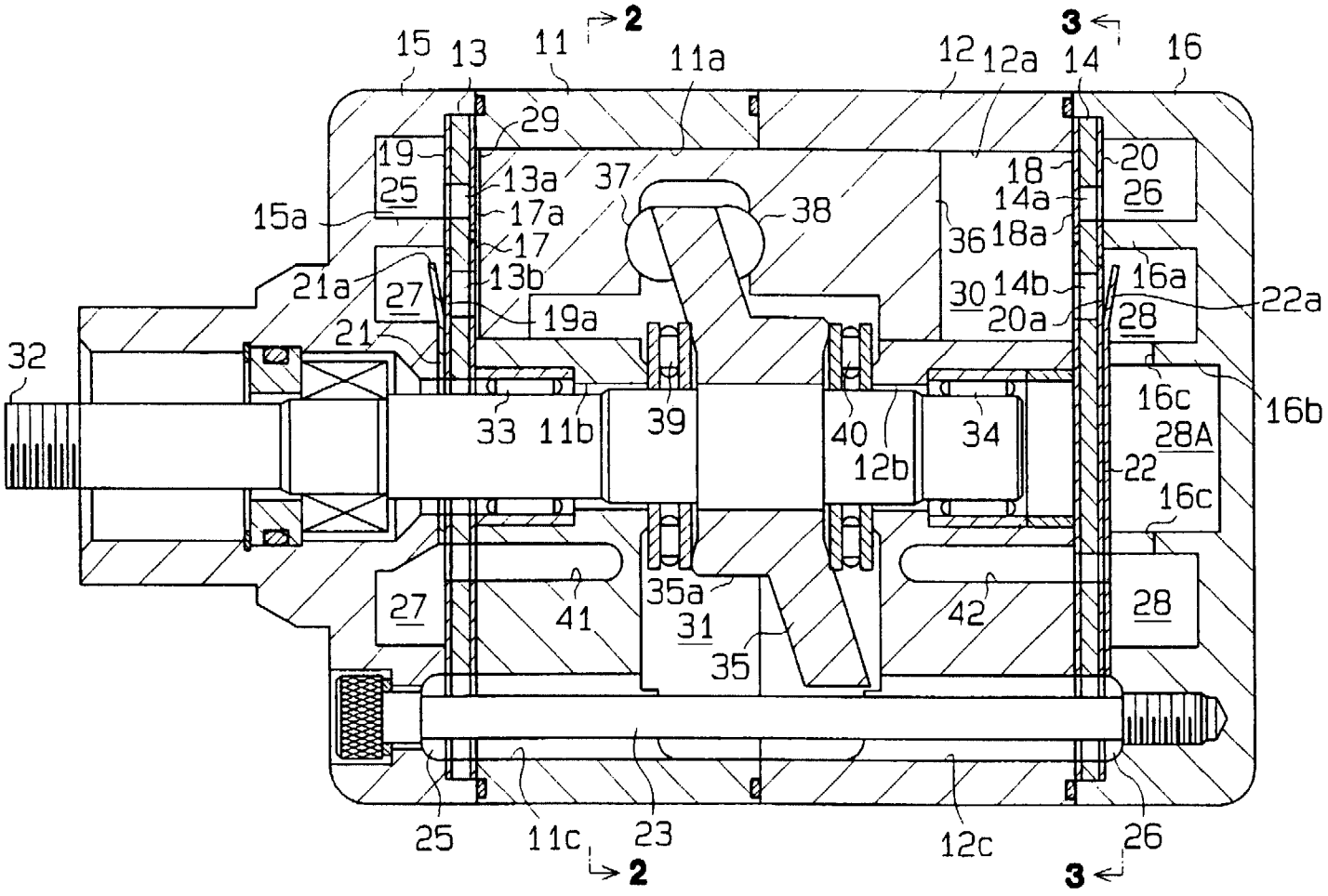
FIG. 1 is a longitudinal cross-sectional view of an overall compressor according to a first preferred embodiment of the invention.

As shown in FIG. 1, a front cylinder block 11 and a rear cylinder block 12 are secured to each other at facing ends thereof. A front housing 15 is secured to a front end face of the front cylinder block 11 through a valve plate 13. A rear housing 16 is secured to the rear end face of the rear cylinder block 12 through a valve plate 14. First plates 17 and 18 form suction valves 17*a* and 18*a* that are located between the cylinder block 11 and the valve plate 13 and between the cylinder block 12 and the valve plate 14, respectively. Second plates 19 and 20 form discharge valves 19*a* and 20*a* and are located between the valve plate 13 and the front housing 15 and between the valve plate 14 and the rear housing 16, respectively. Third plates 21 and 22 form retainers 21*a* and 22*a* and are located between the second plate 19 and the front housing 15 and between the second plate 20 and the rear housing 16, respectively. The retainer 21*a* regulates the degree of opening of the discharge valve 19*a*. Likewise, the retainer 22*a* regulates the degree of opening of the discharge valve 20*a*.

Figure 2:
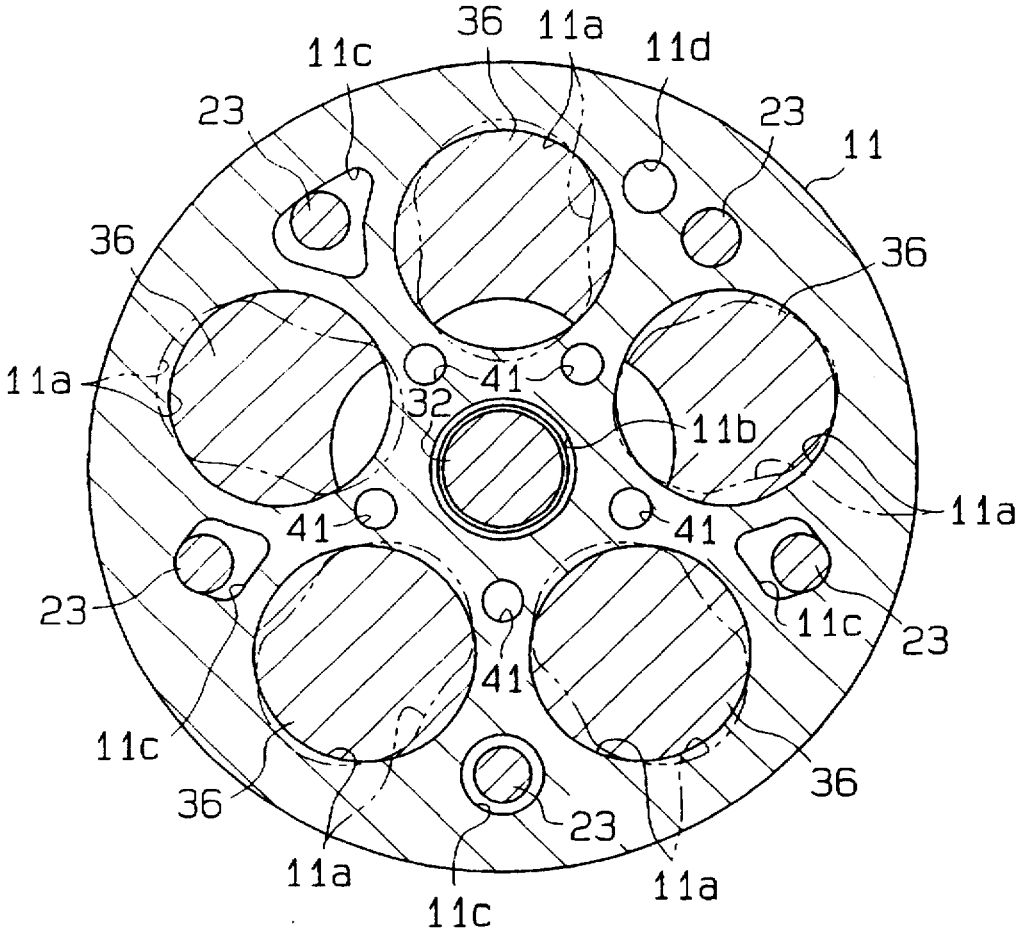
FIG. 2 is a cross-sectional view taken substantially along the line 2—2 in FIG. 1.
Figure 3:
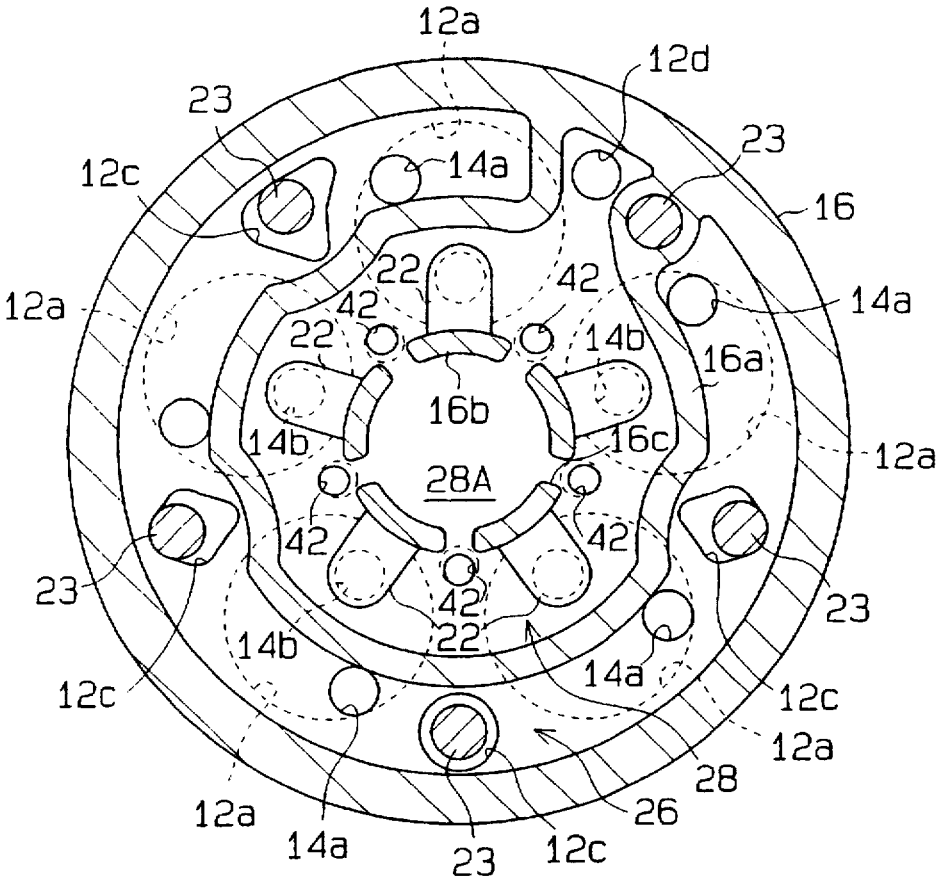
FIG. 3 is a cross-sectional view taken substantially along the line 3—3 in FIG. 1.

As shown in FIGS. 1 to 3, a plurality of bolts 23 (five bolts in this embodiment) are screwed from the front surface 25 of the front housing 15 into the internally threaded bore of the rear housing 16 so that the cylinder blocks 11 and 12, the valve plates 13 and 14, the housings 15 and 16, the first plates 17 and 18, the second plates 19 and 20, and the third plates 21 and 22 are integrally clamped and fixed. The cylinder blocks 11 and 12, and the housings 15 and 16 constitute a housing body.

A drive shaft 32 is rotatably supported in center bores 11*b* and 12*b* of both the cylinder blocks 11 and 12 through radial bearings 33 and 34. A plurality of aligned pairs of cylinder bores 11*a* and 12*a* are formed in the cylinder blocks 11 and 12 around the drive shaft 32. A double-headed piston 36 is housed in each corresponding pair of cylinder bores 11*a* 10 and 12*a*. Compression chambers 29 and 30 are formed in the cylinder bores 11*a* and 12*a* by the piston 36.

A crank chamber 31 is formed in both the cylinder blocks 11 and 12 so as to be positioned between the front and rear cylinder bores 11*a* and 12*a*. A swash plate 35 is fixed to the drive shaft 32 in the crank chamber 31 and is connected to the intermediate portion of each piston 36 through a pair of hemispherical shoes 37 and 38. As the drive shaft 32 is rotated, the rotation of the swash plate 35 is transmitted to each piston 36 through the shoes 37 and 38, and consequently, each piston 36 is reciprocated in the cylinder bores 11*a* and 12*a*. A pair of thrust bearings 39 and 40 are located, in the crank chamber 31, between the inner wall surface of the cylinder block 11 and one end face of the boss portion 35*a* of the swash plate 35 and between the inner wall surface of the cylinder block 12 and the other end face of the boss portion 35*a*, respectively.

Discharge chambers 27 and 28 are formed in the center portions of the front and rear housings 15 and 16, respectively. Suction chambers 25 and 26 are formed in the front and rear housings 15 and 16 around the discharge chambers 27 and 28. A partition wall 15*a* is formed in the front housing 15 so that the discharge chamber 27 and the suction chamber 25 are separated from each other, and likewise, a partition wall 16*a* is formed in the rear housing 16 so that the discharge chamber 28 and the suction chamber 26 are separated from each other. An annular projection 16*b* is formed in the inner wall surface of the rear housing 16 for pressing the second and third plates 20 and 22 against the valve plate 14. A plurality of notches 16*c* are formed in the projection 16*b* so that a space 28A enclosed by the projection 16*b* communicates with the discharge chamber 28. The space 28A, therefore, forms part of the discharge chamber 28.

A suction port 13*a* is formed in the valve plate 13 so that the suction chamber 25 and the compression chamber 29 are connected with each other. A suction port 14*a* is formed in the valve plate 14 so that the suction chamber 26 and the compression chamber 30 are connected with each other. Likewise, discharge ports 13*b* and 14*b* are formed in the valve plates 13 and 14 so that the discharge chamber 27 and the compression chamber 29 are connected with each other and that the discharge chamber 28 and the compression chamber 30 are connected with each other.

During the suction stroke, where the piston 36 moves from the top dead center to the bottom dead center, the refrigerant gas in the suction chambers 25 and 26 opens the suction valves 17*a* and 18*a* and is drawn from the suction ports 13*a* and 14*a* into the compression chambers 29 and 30. During the compression and discharge strokes, where the piston 36 moves from the bottom dead center to the top dead center, the refrigerant gas, which has been compressed in the compression chambers 29 and 30, opens the discharge valves 19*a* and 20*a* and is discharged from the discharge ports 13*b* and 14*b* to the discharge chambers 27 and 28.

A plurality of suction passages 11*c* and 12*c* are formed around the bolts 23 and in the cylinder blocks 11 and 12 so that the crank chamber 31 and the suction chambers 25 and 26 are connected with each other, respectively. The crank chamber 31 is connected to the introduction pipe of an external refrigerant circuit (not shown). The refrigerant gas flowing through the external refrigerant circuit is introduced into the crank chamber 31 through the introduction pipe. Discharge passages 11*d* (FIG. 2) and 12*d* (FIG. 3) are formed in the cylinder blocks 11 and 12 so that they connect with discharge chambers 27 and 28, respectively. The discharge passages 11*d* and 12*d* are connected to the discharge pipe of the external refrigerant circuit. The refrigerant gas in the discharge chambers 27 and 28 is discharged to the discharge pipe through the discharge passages 11*d* and 12*d*.

A plurality of cavities 41, which are connected with the discharge chamber 27 on the front side, are located around the center portion of the front cylinder block 11, as shown in FIG. 2, and each cavity 41 is located between adjacent cylinder bores 11*a* and is formed in the front cylinder block 11, the first plate 17, the valve plate 13, and the second plate 19. Likewise, a plurality of rear cavities 42, which are connected with the discharge chamber 28 on the rear side, are located around the center portion of the rear cylinder block 12, as shown in FIG. 3, and each cavity 42 is located between adjacent cylinder bores 12*a* and is formed in the rear cylinder block 12, the first plate 18, the valve plate 14, and the second plate 20. These cavities 41 and 42 are located in the vicinities of the parts of the cylinder bores 11*a* and 12*a* that are deformed in the radially outward directions (with respect to the cylinder bores 11*a* and 12*a*). In other words, cavities 41 and 42 are located in the positions where the radially outward deformations of the inner peripheral surfaces of the cylinder bores 11*a* and 12*a* need to be reduced. The cavities 41 and 42 extend along the axial direction of the cylinder bores 11*a* and 12*a*. The axial lengths of the cavities 41 and 42 are nearly the same as the axial lengths of the cylinder bores 11*a* and 12*a*.

The function of the compressor with the above-mentioned structure may be described as follows:

If the drive shaft 32 is rotated by an external power source such as an engine of an automobile, the rotation will be converted to the reciprocating motion of the piston 36 in the cylinder bores 11*a* and 12*a* through the swash plate 35. As the piston 36 is reciprocated, the refrigerant gas introduced from the introduction pipe of the external refrigerant circuit into the crank chamber 31 is introduced into the suction chambers 25 and 26 through the suction passages 11*c* and 12*c* and then from the suction chambers 25 and 26 into the compression chambers 29 and 30. The refrigerant gas in the compression chambers 29 and 30 is compressed by the piston 36 and then is discharged to the discharge chambers 27 and 28. The high-pressure refrigerant gas in the discharge chambers 27 and 28 is discharged to the discharge pipe of the external refrigerant circuit through the discharge passages 11*d* and 12*d* and is supplied to the condenser, expansion valve, and evaporator (not shown) of the external refrigerant circuit. Consequently, the interior of the vehicle is air-conditioned.

Figure 4:
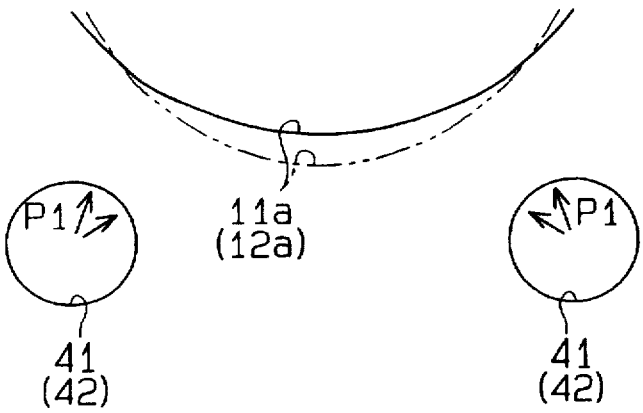
FIG. 4 is an explanatory view showing the operation of a compressor constructed according to the first embodiment.

During the operation of the compressor, some of the high-pressure refrigerant gas in the discharge chambers 27 and 28 flows into cavities 41 and 42. The high pressure of the refrigerant gas acts on the inner peripheral surfaces of the cavities 41 and 42 such that the deformation of the inner peripheral surfaces of the cylinder bores 11*a* and 12*a* discussed above is reduced. More particularly, as shown in FIG. 4, the pressure of the refrigerant gas in each cavity 41 or 42 presses the inner peripheral surface of each cavity 41 or 42 in the radially outward direction (indicated by the arrow P1) of the cavity. This force presses the radially outwardly deformed portion of the inner peripheral surface of each cylinder bore 11*a* or 12*a* in the radially inward direction of the cylinder bore. Therefore, with this pressing force, the radially outward deformation of the inner peripheral surface of each cylinder bore 11*a* or 12*a* is reduced. In addition, as the radially outward deformation of the inner peripheral surface of each cylinder bore 11*a* or 12*a* is reduced, the radially inward deformation of the inner peripheral surface of each cylinder bore 11*a* or 12*a* is also reduced.

Figure 10:
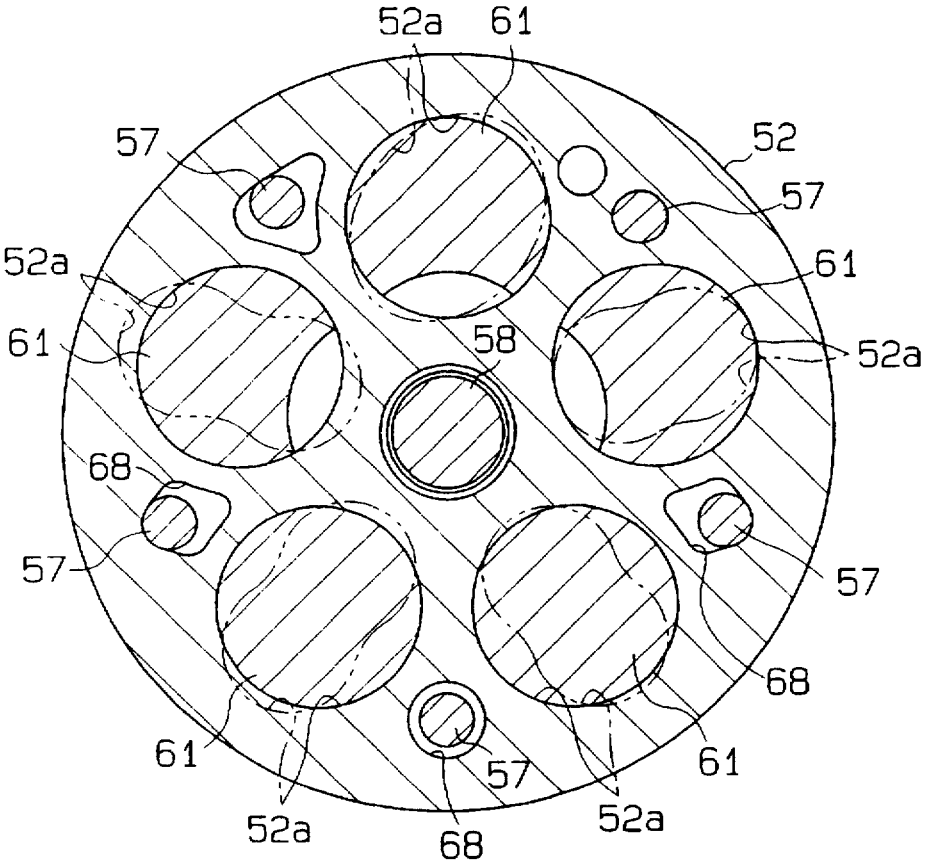
Fig.10 (Prior Art)
FIG. 10 is a cross-sectional view taken substantially along the line 10—10 in FIG. 9.

The broken lines in FIG. 2 represent the deformed configuration of the inner peripheral surface of each cylinder bore 11*a* or 12*a* during the operation of the compressor. The deformation degree is exaggerated for purposes of illustration. As is evident from a comparison between the broken line in FIG. 2 and the broken line in FIG. 10 showing a conventional compressor, even if the inner peripheral surfaces of the cylinder bores 11*a* and 12*a* are deformed when the cylinder blocks 11 and 12 are clamped together by the bolts 23, the deformations will be reduced at the time of the operation of the compressor in this embodiment. It has been confirmed in the compressor of this embodiment that the degree of radially outward deformation of each cylinder bore 11*a* or 12*a* is suppressed to about 2 μm at the maximum and that the degree of radially inward deformation of each cylinder bore 11*a* or 12*a* is suppressed to about 5 μm at the maximum.

For this reason, the clearance between the inner peripheral surface of each cylinder bore 11*a* or 12*a* and the outer peripheral surface of the piston 36 is more uniform over the entire circumference. Consequently, leakage of the refrigerant gas from the compression chambers 29 and 30 is suppressed and the compression efficiency of the refrigerant gas is enhanced. Moreover, portions of the inner peripheral surfaces of the cylinder bores 11*a* and 12*a* are prevented from being tightly pressed against the outer peripheral surface of the piston 36, thus reducing friction along the cylinder bores 11*a* and 12*a*. Therefore, the wear on the piston 36 and the wear on the cylinder bores 11*a* and 12*a* is suppressed, and the piston 36 is prevented from being damaged by seizing or the like. Thus, the durability of the compressor is enhanced.

The compressed refrigerant gas, discharged from the compression chambers 29 and 30 to the discharge chambers 27 and 28, also flows into the cavities 41 and 42. In other words, the cavities 41 and 42 form part of the discharge chambers 27 and 28, respectively. Furthermore, the space 28A forming part of the discharge chamber 28 is defined in the center portion of the rear housing 16. For these reasons, the volume of the entire discharge chamber is increased. Consequently, the compressed refrigerant gas, discharged from the compression chambers 29 and 30 to the discharge chambers 27 and 28, is reduced to a certain pressure at the discharge chambers 27 and 28 and then is supplied to the external refrigerant circuit through the discharge passages 11*d* and 12*d*. Therefore, pulsation resulting from the discharge of the compressed refrigerant gas and noise resulting from the pulsation is suppressed without increasing the outer size of the compressor.

Figure 5:
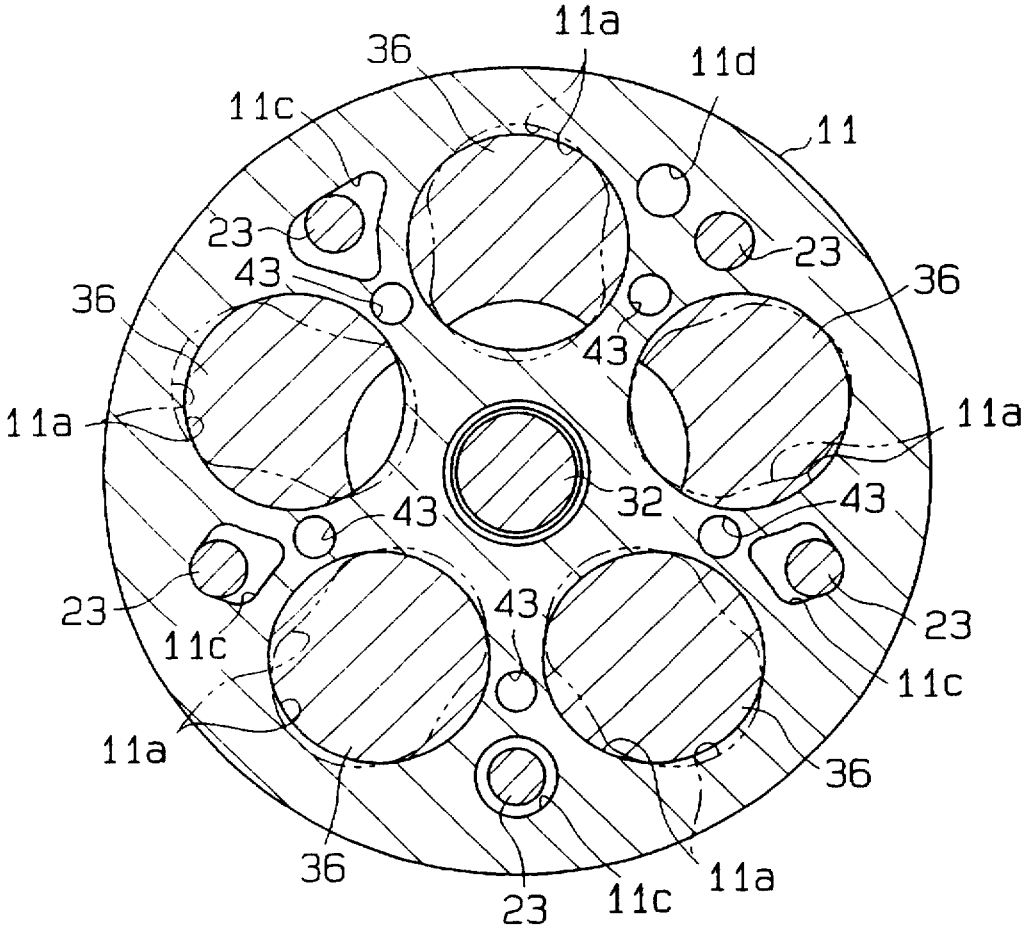
FIG. 5 is a cross-sectional view showing a second embodiment of the compressor of the invention.
Figure 6:
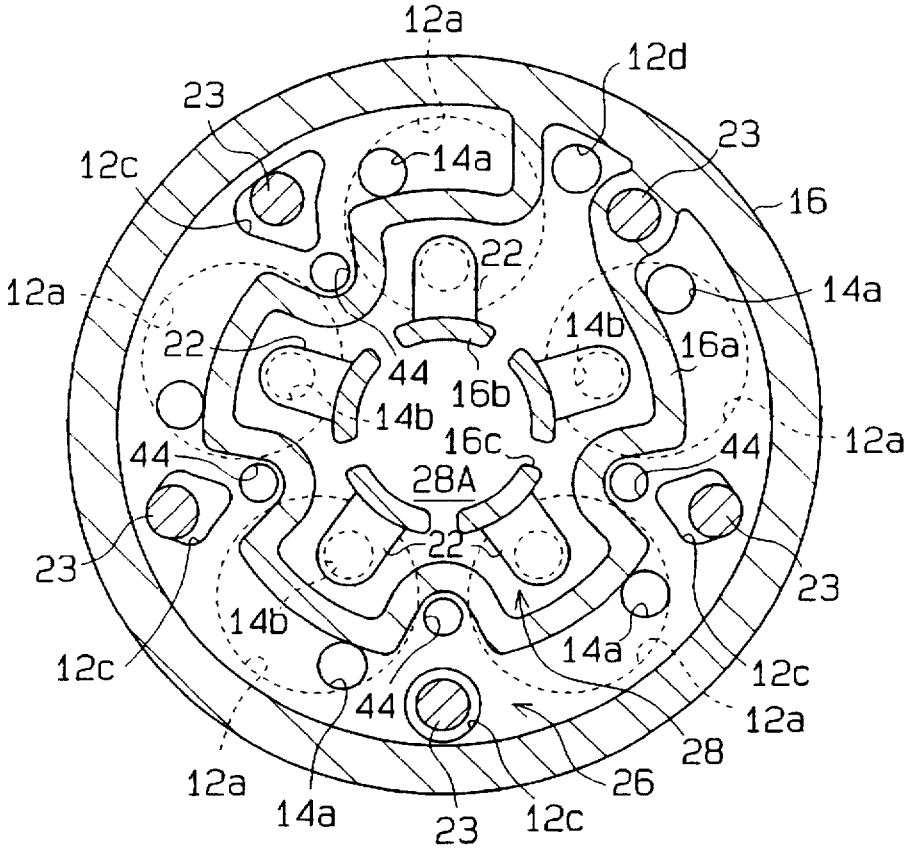
FIG. 6 is a cross-sectional view showing the second embodiment of the compressor.

Now, a second embodiment of the present invention will be described with reference to FIGS. 5 and 6. The same reference numerals will be applied to the same parts and members as those of the first embodiment and therefore the description will not be given. In the second embodiment, as shown in FIGS. 5 and 6, a plurality of cavities 43 and 44 communicating with suction chambers 25 and 26 are provided instead of the cavities 41 and 42 in the first embodiment. Each cavity 43 (or 44) is located between adjacent cylinder bores 11*a* (or 12*a*)and is formed in the cylinder block 11 (or 12), the first plate 17 (or 18), the valve plate 13 (or 14), and the second plate 19 (or 20). These cavities 43 and 44 are located in the vicinities of parts of the cylinder bores 11*a* and 12*a* that are deformed in the radially inward directions (with respect to the cylinder bores). In other words, the cavities 43 and 44 are located in the positions where the radially inward deformations of the inner peripheral surfaces of the cylinder bores 11*a* and 12*a* need to be reduced. The cavities 43 and 44 extend along the axial direction of the cylinder bores 11*a* and 12*a*. The axial length of the cavities 43 and 44 are nearly the same as that of the cylinder bores 11*a* and 12*a*.

The pressure of the refrigerant gas in the suction chambers 25 and 26, which is introduced into the cavities 43 and 44, is lower than that in the compression chambers 29 and 30, where the piston 36 is in the compression and discharge strokes. Furthermore, because of the existence of the cavities 43 and 44, the deformation of the cylinder bores 11*a* and 12*a* is allowed to a certain degree in the vicinities of the portions where the cavities 43 and 44 are formed. If a high pressure corresponding to the discharge pressure acts on the inner peripheral surfaces of the cylinder bores 11*a* and 12*a* during the compression and discharge strokes of the piston 36, then the pressure will press the inner peripheral surfaces of the cylinder bores 11*a* and 12*a* in the radially outward directions of the cylinder bores 11*a* and 12*a*. With this pressing force, the radially inwardly deformed portions of the inner peripheral surfaces of each cylinder bores 11*a* and 12*a* (i.e., portions in the vicinities of the cavities 43 and 44) are deformed in the radially outward directions. Consequently, the radial inward deformation of the inner peripheral surfaces of the cylinder bores 11*a* and 12*a* is reduced. In addition, as the radially inward deformations of the inner peripheral surfaces of the cylinder bores 11*a* and 12*a* are reduced, the radially outward deformation of the inner peripheral surfaces of the cylinder bores 11*a* and 12*a* is also reduced.

Therefore, in the second embodiment, as is similar to the first embodiment, leakage of the refrigerant gas is suppressed and the compression efficiency of the refrigerant as is enhanced. In addition, wear on the piston 36 and the cylinder bores 11*a* and 12*a* is reduced, and the piston 36 and the cylinder bores are prevented from being damaged. Thus, he durability of the compressor is enhanced.

Figure 7:
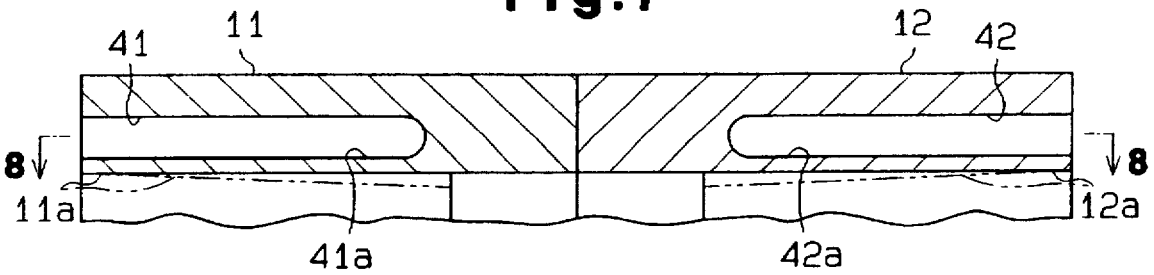
FIG. 7 is a cross-sectional view of essential parts showing a third embodiment of the compressor of the invention.
Figure 8:
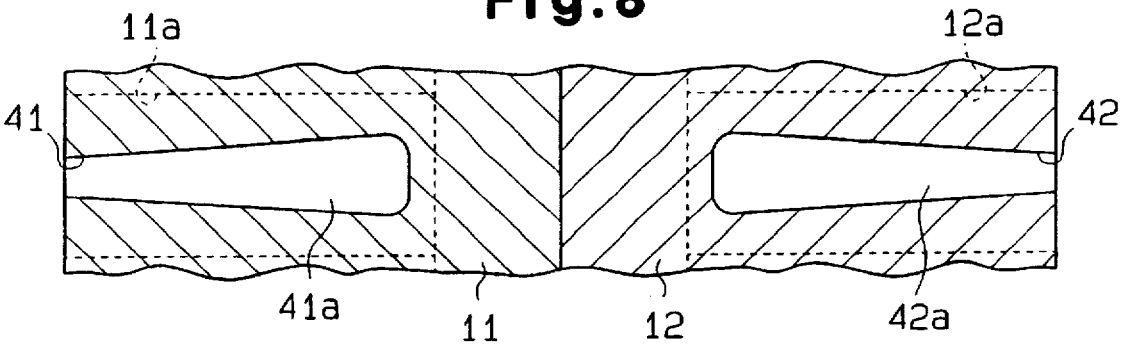
FIG. 8 is a cross-sectional view taken substantially along the line 8—8 in FIG. 7.
Figure 9:
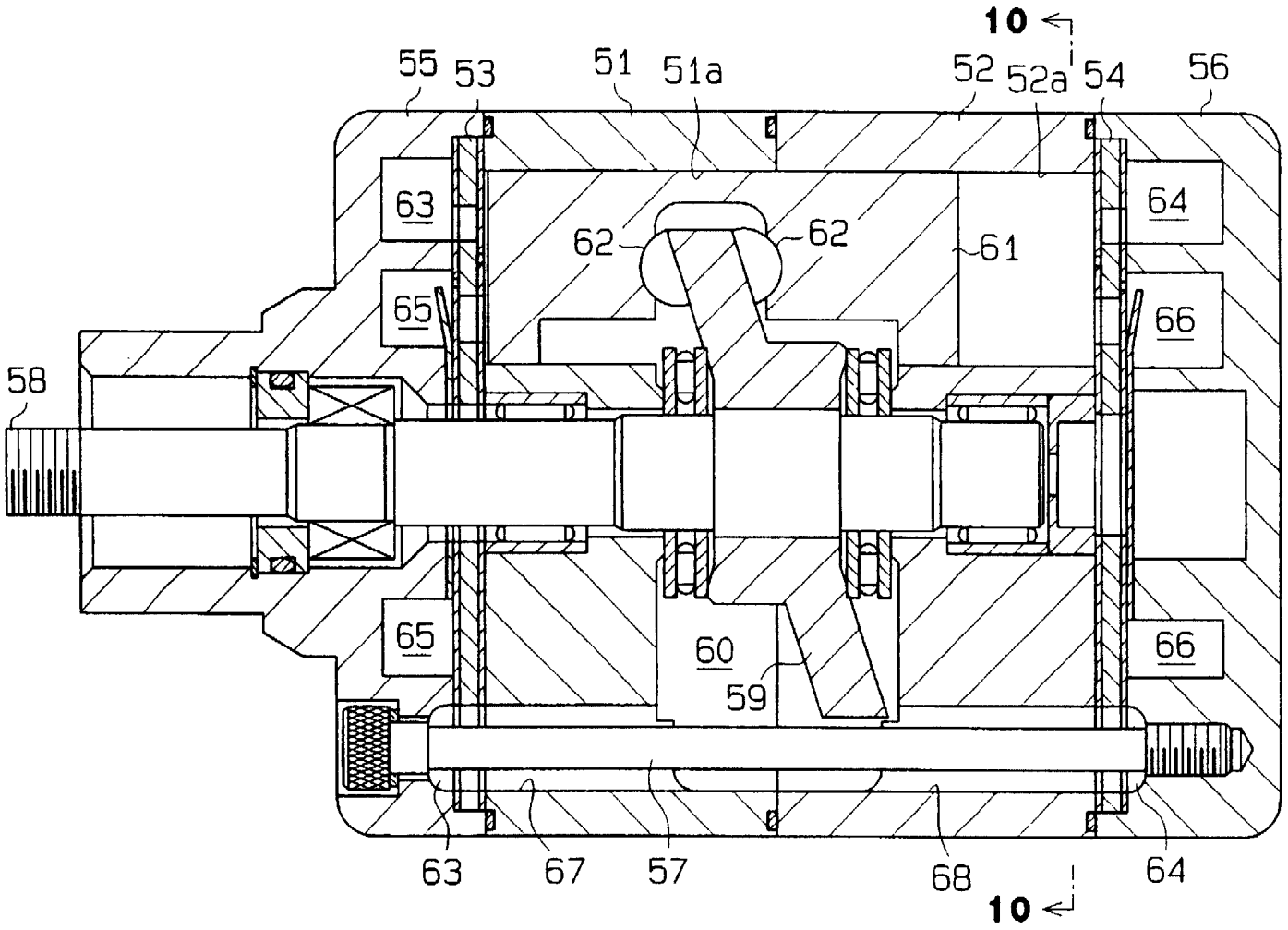
Fig.9 (Prior Art)
FIG. 9 is a longitudinal cross-sectional view showing a conventional swash plate-type compressor.

Now, a third embodiment of the present invention will e described with reference to FIGS. 7 and 8. In this embodiment, the same reference numerals will be applied to the same parts and members as those of the first embodiment and therefore a description will not be given.

Figure 11:
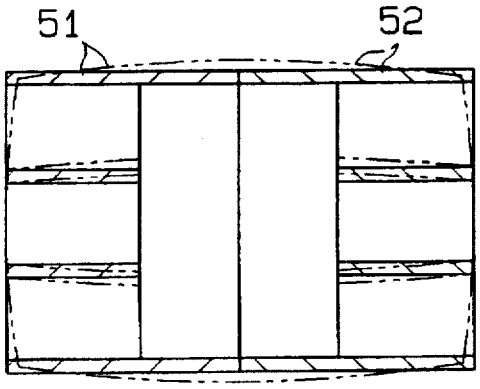
Fig.11 (Prior Art)
FIG. 11 is a schematic cross-sectional side view showing the cylinder block shown in FIG. 9.

As has been described in the conventional compressor shown in FIG. 11, the degree of deformation in the outer diameter of the cylinder blocks 11 and 12 is greater at the adjoining faces thereof (in other words, at the center of the entire structure of the cylinder blocks), as both the cylinder blocks 11 and 12 are clamped together by the bolts 23. Because of the deformation of the cylinder blocks, the deformation of the cylinder bores 11*a* and 12*a* is also greater at the adjoining faces of both the cylinder blocks 11 and 12. For this reason, in the third embodiment, as shown in FIGS. 7 and 8, cavities 41 and 42 communicating with discharge chambers 27 and 28 are formed in the outer circumferences of the cylinder blocks 11 and 12 such that they are located in the vicinities of the portions of the cylinder bores that are deformed in the radially outward directions thereof. In addition, the portions of the cavities 41 and 42 facing the cylinder bores 11*a* and 12*a* are larger toward the adjoining ends of both cylinder blocks 11 and 12 (toward the center of the entire structure of the cylinder blocks) in the axial direction of the drive shaft 32.

With this structure, the inner peripheral surfaces of the cylinder bores 11*a* and 12*a* will be pressed in the radially inward directions (with respect to the bores) with larger forces nearer to the adjoining ends of both cylinder blocks 11 and 12, i.e., the end where the degree of deformation of the cylinder bores 11*a* and 12*a* is greater. The degree of radially inward deformation of the cylinder bores 11*a* and 12*a* caused by the pressing forces is greater at the adjoining ends of both cylinder blocks 11 and 12 as shown by two-dot chain lines in FIG. 7. Reduction in the deformations of the cylinder bores 11*a* and 12*a* is greater nearer to the adjoining ends of the both cylinder blocks 11 and 12. As a consequence, the clearance between the inner surface of each cylinder bore 11*a* or 12*a* and the outer surface of each piston 36 becomes nearly constant in the axial direction of the drive shaft 32.

Therefore, in the third embodiment, as in first and second embodiments, leakage of the refrigerant gas is suppressed and the compression efficiency of the refrigerant gas is enhanced. In addition, the wear on the piston 36 and the cylinder bores 11*a* and 12*a* is suppressed, they are prevented from being damaged, and the durability of the compressor is enhanced.

The present invention may be also embodied as follows:

(1) The structure of the compressor in the third embodiment is applicable nearly in the same way to the cavities 43 and 44 communicating with the suction chambers 25 and 26 in the second embodiment. That is, the cavities 43 and 44 may be formed such that the diameters of the inner peripheral surfaces thereof increase nearer to the adjoining ends of both cylinder blocks 11 and 12 in the axial direction of the drive shaft 32. If constructed like this, the degree of radially outward deformation of the cylinder bores 11*a* and 12*a* will increase toward the adjoining ends of both cylinder blocks 11 and 12, when the inner surfaces of the cylinder bores 11*a* and 12*a* are pressed with the high pressures of the compression chambers 29 and 30. Therefore, the deformation of the cylinder bores 11*a* and 12*a* is reduced more at the adjoining ends of the both cylinder blocks 11 and 12. As a consequence, the clearance between the inner peripheral surface of each cylinder bore 11*a* or 12*a* and the outer peripheral surface of each piston 36 becomes nearly constant in the axial direction of the drive shaft 32, and the advantages of the third embodiment are obtained.

(2) While the cavities 41 and 42 extend along the axial direction of the cylinder bores 11*a* and 12*a* in the first and third embodiments, the cavities 41 and 42 may be curved in the circumferential directions of the cylinder bores 11*a* and 12*a* in the range of the position where the radially outward deformations of the inner peripheral surfaces of the cylinder bores 11*a* and 12*a* are to be reduced.

(3) The present invention can be used with any type of piston compressors, such as a swash plate-type compressor of a single head piston type and a variable displacement-type compressor of the piston type where a discharge displacement can be adjusted by changing the angle of inclination of a swash plate.

(4) In the first and third embodiments, while the cavities 41 and 42 are formed in the cylinder blocks for reducing the deformation of the cylinder bores 11*a* and 12*a*, chambers may be formed in the front and rear housings 15 and 16 to communicate with the discharge chambers 27 and 28 instead of the cavities 41 and 42. In such case, when the high-pressure refrigerant gas in the discharge chambers 27 and 28 is introduced into the aforementioned chambers, wedge members are actuated through actuating members. The cylinder bores 11*a* and 12*a* are thus pressed in the radially inward direction of the bores using the wedge members, whereby the deformation of the bores 11*a* and 12*a* may be reduced.

(5) In the second embodiment and the embodiment stated in part (1) above, the cavities 43 and 44 need not always be in fluid communication with the suction chambers 25 and 26, and therefore the cavities 43 and 44 may be formed in the cylinder blocks 11 and 12 such that they do not communicate with the suction chambers 25 and 26.

Therefore, the present examples and embodiments are to be considered as illustrative and not restrictive and the invention is not to be limited to the details given herein, but may be modified within the scope of the appended claims.

What is claimed is:

1. A compressor, comprising:

a housing body;

a drive shaft rotatably supported in the housing body;

a swash plate mounted on the drive shaft;

at least one cylinder bore defined in the housing body;

at least one piston operably coupled to the swash plate and disposed in the cylinder bore, wherein said swash plate converts a rotation of the drive shaft to a reciprocating movement of the piston along an inner surface of the cylinder bore to compress gas supplied from a suction chamber to the cylinder bore and discharge the compressed gas to a discharge chamber; and means for reducing a deformation of the inner surface of the cylinder bore by utilizing pressure of the gas compressed in the cylinder bore.

2. The compressor as set forth in claim 1, wherein said reducing means includes at least one cavity defined in the housing body.

3. The compressor as set forth in claim 2, wherein a plurality of the cylinder bores are disposed around the drive shaft, and wherein said cavity is defined between the adjacent cylinder bores.

4. The compressor as set forth in claim 2, wherein said cavity extends in parallel with a substantially entire axial direction with respect to the cylinder bore.

5. The compressor as set forth in claim 2, further comprising:

said housing body including a cylinder block which has said cylinder bore, said housing body including a housing member coupled to the cylinder block to define the suction chamber and the discharge chamber;

a bolt for fastening the cylinder block with the housing member; and said cylinder block housing the cavity.

6. The compressor as set forth in claim 5, further comprising:

said cylinder block including a front member and a rear member, said front member and said rear member respectively having first ends opposed and coupled to each other and second ends coupled away from each other, said front member and said rear member respectively having the cylinder bore and the cavity, said cylinder bore and said cavity extending from the second ends toward the first ends; and said housing member having a front housing and a rear housing, said front housing and said rear housing respectively coupled to the second ends of the front member and the rear member.

7. The compressor as set forth in claim 2, wherein said cavity communicates with the discharge chamber, and wherein said cavity is located in a position to reduce a radially outward deformation of the inner surface of the cylinder bore.

8. The compressor as set forth in claim 7, wherein said cavity is located close to a portion of the inner surface of the cylinder bore, said portion being subject to the radially outward deformation, and wherein said compressed gas introduced to the cavity from the discharge chamber applies counter force to the portion that tends to be deformed.

9. The compressor as set forth in claim 6 further comprising:

each cavity communicating with the discharge chamber; each cavity being located close to a portion of the inner surface of the cylinder bore, said portion being subject to the radially outward deformation;

said compressed gas introduced to each cavity from the discharge chamber applying counter force to the portion that tends to be deformed; and each cavity including an inner surface which has a pressure receiving portion closer to the cylinder bore than the other portions of the inner surface, wherein each pressure receiving portion is greater toward the first ends of the front member and the rear member respectively.

10. The compressor as set forth in claim 2, wherein said cavity is located in a position to reduce a radially inward deformation of the inner surface of the cylinder bore.

11. The compressor as set forth in claim 10, wherein said cavity is located close to a portion of the inner surface of the cylinder bore, said portion being subject to the radially inward deformation, and wherein the cavity permits a reformation of the portion by means of the pressure in the cylinder bore.

12. The compressor as set forth in claim 11, wherein said cavity communicates with the suction chamber.

13. A compressor, comprising:

a housing body;

a drive shaft rotatably supported in the housing body;

a swash plate mounted on the drive shaft;

at least one cylinder bore defined in the housing body;

at least one piston operably coupled to the swash plate and disposed in the cylinder bore, wherein said swash plate converts a rotation of the drive shaft to a reciprocating movement of the piston along an inner surface of the cylinder bore to compress gas supplied from a suction chamber to the cylinder bore and discharge the compressed gas to a discharge chamber;

said housing body having at least one cavity communicating with the discharge chamber; and said cavity being located close to a portion of the inner surface of the cylinder bore, said portion being subject to the radially outward deformation, wherein said compressed gas introduced to the cavity from the discharge chamber applies counter force to the portion that tends to be deformed to reduce any radially outward deformation of the inner surface of the cylinder bore that might otherwise occur.

14. The compressor as set forth in claim 13, wherein a plurality of the cylinder bores are disposed around the drive shaft, and wherein said cavity extends in parallel with an axial direction with respect to each cylinder bore between the adjacent cylinder bores.

15. The compressor as set forth in claim 14 further comprising:

said housing body including a cylinder block which has said cylinder bores, said housing body including a housing member coupled to the cylinder block to define the suction chamber and the discharge chamber;

a bolt for fastening the cylinder block with the housing member; and said cylinder block housing the cavity.

16. The compressor as set forth in claim 15, further comprising:

said cylinder block including a front member and a rear member, said front member and said rear member respectively having first ends opposed and coupled to each other and second ends away from each other, said front member and said rear member respectively housing the cylinder bores and the cavity, said cylinder bores and said cavity extending from the second ends toward the first ends; and said housing member having a front housing and a rear housing, said front housing and said rear housing respectively coupled to the second ends of the front member and the rear member.

17. The compressor as set forth in claim 16, wherein each cavity includes an inner surface which has a pressure receiving portion closer to the cylinder bore than the other portions of the inner surface, wherein each pressure receiving portion is greater toward the first ends of the front member and the rear member respectively.

18. A compressor, comprising:

a housing body;

a drive shaft rotatably supported in the housing body;

a swash plate mounted on the drive shaft;

at least one cylinder bore defined in the housing body and at least one piston operably coupled to the swash plate and disposed in the cylinder bore, wherein said swash plate converts a rotation of the drive shaft to a reciprocating movement of the piston along an inner surface of the cylinder bore to compress gas supplied from a suction chamber to the cylinder bore and discharge the compressed gas to a discharge chamber;

said housing body having at least one cavity; and said cavity being located close to a portion of the inner surface of the cylinder bore, said portion being subject to the radially inward deformation, wherein said cavity permits a reformation of the portion by means of the pressure in the cylinder bore.

19. The compressor as set forth in claim 18, wherein said cavity communicates with the suction chamber.

20. The compressor as set forth in claim 18, wherein a plurality of the cylinder bores are disposed around the drive shaft, and wherein said cavity extends in parallel with an axial direction with respect to each cylinder bore between the adjacent cylinder bores.

21. The compressor as set forth in claim 20 further comprising:

said housing body including a cylinder block which has said cylinder bores, said housing body including a housing member coupled to the cylinder block to define the suction chamber and the discharge chamber;

a bolt for fastening the cylinder block with the housing member; and said cylinder block housing the cavity.

22. The compressor as set forth in claim 21, further comprising:

said cylinder block including a front member and a rear member, said front member and said rear member respectively having first ends opposed and coupled to each other and second ends away from each other, said front member and said rear member respectively housing the cylinder bores and the cavity, said cylinder bore and said cavity extending from the second ends toward the first ends; and said housing member having a front housing and a rear housing, said front housing and said rear housing respectively coupled to the second ends of the front member and the rear member.

* * * * *